US005673518A

United States Patent [19]

Paddock

[11] Patent Number: 5,673,518

[45] Date of Patent: Oct. 7, 1997

[54] DECK ASSEMBLY FOR RETROFITTING BLEACHERS

[75] Inventor: Eugene T. Paddock, Downers Grove, Ill.

[73] Assignee: E.T. Paddock Enterprises, Inc., Lockport, Ill.

[21] Appl. No.: 730,714

[22] Filed: Oct. 15, 1996

Related U.S. Application Data

[63] Continuation of Ser. No. 522,986, Sep. 7, 1995, Pat. No. 5,605,025.

[51] Int. Cl.[6] ..... E04H 3/12

[52] U.S. Cl. ..... 52/9; 52/8

[58] Field of Search ..... 52/8, 9

[56] References Cited

U.S. PATENT DOCUMENTS

| | | | |
|---|---|---|---|
| 2,817,389 | 12/1957 | Richards | 52/8 |
| 3,667,171 | 6/1972 | McClelland et al. | 52/9 |
| 4,193,229 | 3/1980 | Hartman | 52/9 |
| 4,409,762 | 10/1983 | Raymond | 52/9 |
| 4,571,895 | 2/1986 | Lyman | 52/9 |
| 5,369,918 | 12/1994 | Bev | 52/9 |
| 5,605,025 | 2/1997 | Paddock | 52/741.3 |

*Primary Examiner*—Robert Canfield

*Attorney, Agent, or Firm*—Lee, Mann, Smith, McWilliams, Sweeney & Ohlson

[57] ABSTRACT

A deck assembly is provided for retrofitting bleachers having a plurality of rows of seats and a foot board supported by a plurality of floor support members located between adjacent rows of seats. The deck assembly includes an elongate walkway panel adapted to be supported by the floor support members between adjacent rows of seats. The walkway panel includes a first elongate edge and a spaced apart second elongate edge. A toe riser including an upstanding flange extends along and upwardly from the first elongate edge of the walkway panel. The flange of the toe riser is adapted to extend from the first elongate edge of the walkway panel toward a forward row of seats. A heel riser having an upstanding flange extends along and upwardly from the second edge of the walkway panel. The flange of the heel riser is adapted to extend from the second elongate edge of the walkway panel toward an adjacent rear row of seats. The walkway panel provides a walkway surface between the adjacent front and rear row of seats and the heel and toe risers substantially enclose the areas between the walkway panel and the front and rear row of seats to prevent the passage of objects therebetween.

9 Claims, 4 Drawing Sheets

DECK ASSEMBLY FOR RETROFITTING BLEACHERS

RELATED APPLICATIONS

This is a continuation of patent application Ser. No. 08/522,986, filed on Sep. 7, 1995, now U.S. Pat. No. 5,605,025, issued Feb. 25, 1997.

BACKGROUND OF THE INVENTION

The present invention is directed to a deck assembly for use in retrofitting existing bleachers by replacing the foot board of the bleachers which provides a walkway surface, and in particular to a deck assembly including a toe riser and a heel riser for substantially enclosing the areas between the walkway surface and the adjacent rows of seats in the bleachers.

Many existing installations of bleachers include narrow foot boards which are located between adjacent rows of seats. These narrow foot boards leave large openings in the areas between the foot board and the rows of seats to the front and to the rear of the foot board. A spectator walking along the narrow foot board can easily have a foot slip through these openings. In addition, the openings pose the danger of a small child falling through the opening and of personal belongings of spectators falling through the openings. Safety codes that have issued since the installation of such bleachers require that any opening between the seat board and foot board that is located more than thirty inches above grade shall be provided with intermediate construction such that a four inch diameter sphere cannot pass. Many existing installations of bleachers do not meet the code requirement as the openings in the areas between the seat board and the foot board are dangerously large and will allow a four inch diameter sphere to pass. The present invention allows the retrofitting of existing non-code bleachers into compliance with safety code requirements.

SUMMARY OF THE INVENTION

A deck assembly is provided for retrofitting existing bleachers having a plurality of rows of seats and a plurality of foot boards supported on a plurality of floor support members which extend between the adjacent rows of seats. The deck assembly includes an elongate walkway panel adapted to be supported by the floor support members between adjacent rows of seats after the existing foot board has been removed. The walkway panel includes a generally planar upper walkway surface and an opposing lower surface which is adapted to be supported by the walkway support members. The walkway panel includes a first elongate edge and a spaced apart and generally parallel second elongate edge.

The retrofit deck assembly also includes an elongate toe riser which extends adjacent to and along the first elongate edge of the walkway panel. The toe riser includes a base which is adapted to engage and be supported by the floor support members and to engage the lower surface of the walkway panel. The toe riser also includes an upstanding flange attached to the base such that the toe riser is generally L-shaped. The flange extends along and upwardly from the first elongate edge of the walkway panel to a top edge. The retrofit deck assembly also includes an elongate heel riser which extends along and adjacent to the second elongate edge of the walkway panel. The heel riser includes a base which is adapted to engage and be supported by the floor support members and to engage the lower surface of the walkway panel. The heel riser also includes an upstanding flange attached to the base such that the heel riser is generally L-shaped or, alternatively, Z-shaped. The flange of the heel riser extends along and upwardly from the second elongate edge of the walkway panel to a top edge.

The retrofit deck assembly replaces the removed original foot board and is secured to the floor support members by fasteners. The flange of the toe riser extends from the first elongate edge of the walkway panel toward the forwardly located row of seats and the flange of the heel riser extends upwardly from the second elongate edge of the walkway panel toward the rearwardly located row of seats, such that the toe riser and heel riser substantially enclose the areas between the walkway panel and the forwardly and rearwardly adjacent rows of seats.

DETAILED DESCRIPTION OF THE PREFERRED EMBODIMENTS

Figure 1:
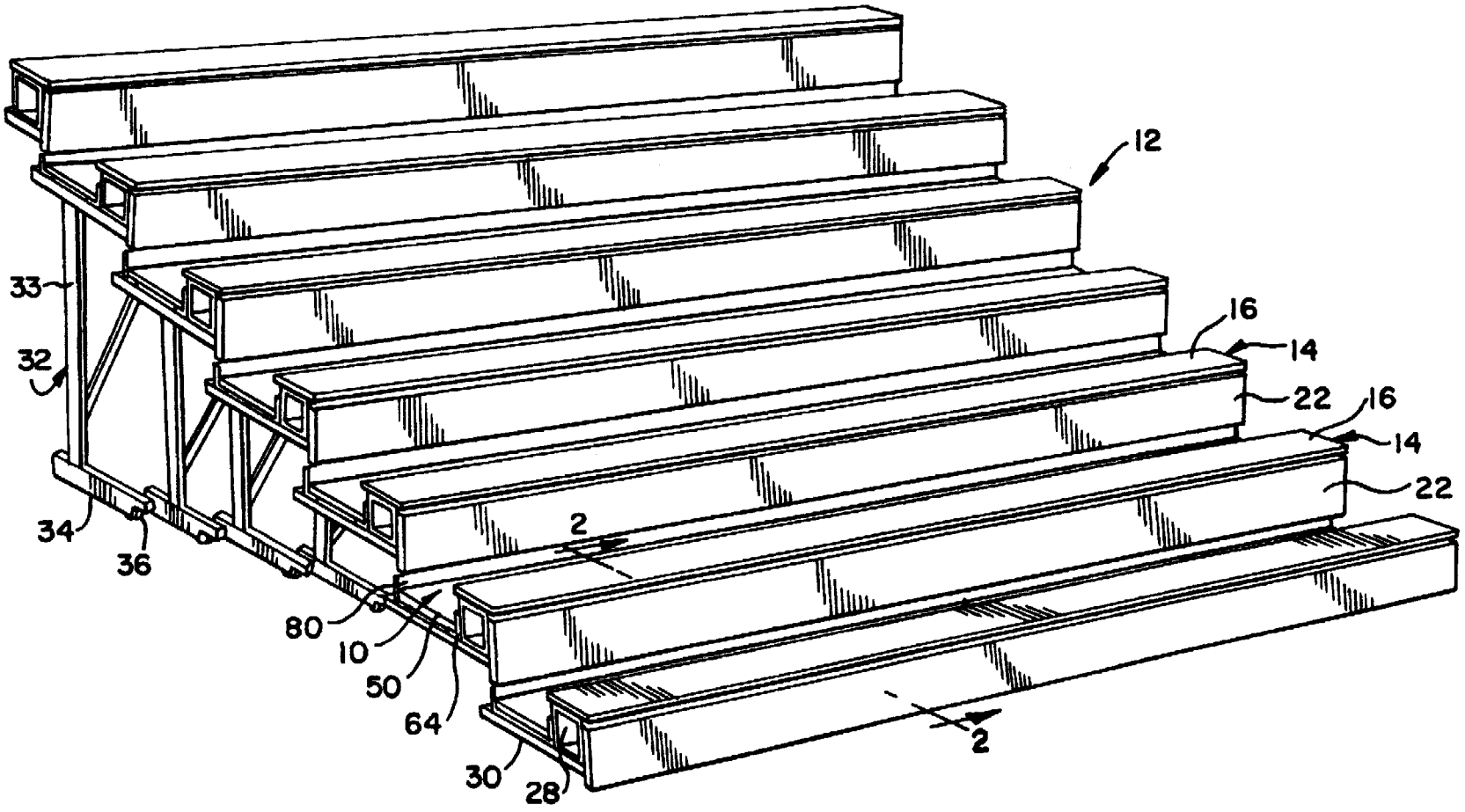
FIG. 1 is a perspective view of bleachers including the retrofit deck assembly of the present invention.
Figure 4:
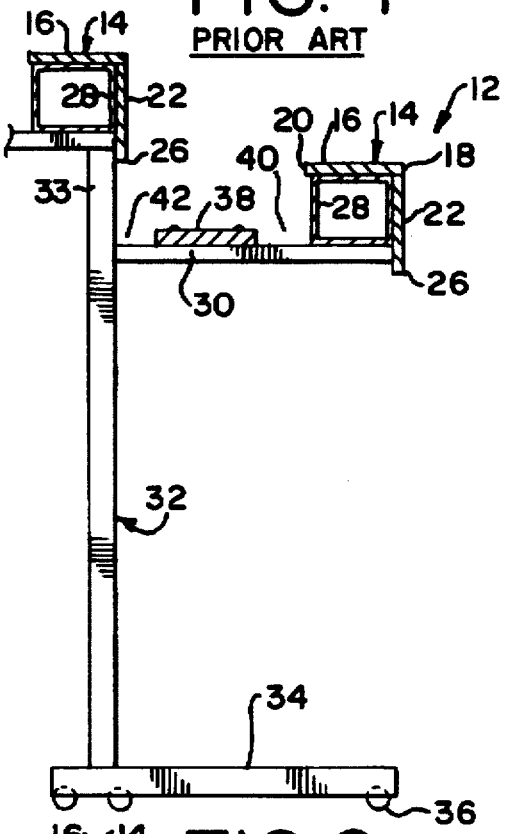
FIG. 4 PRIOR ART
FIG. 4 is a partial cross-sectional view of bleachers prior to being retrofit with the deck assembly.
Figure 5:
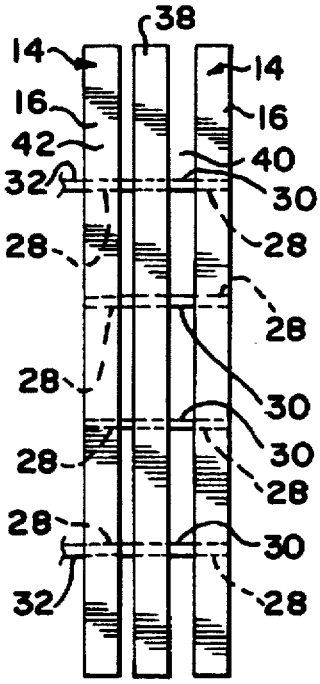
FIG. 5 PRIOR ART
FIG. 5 is a partial plan view of bleachers prior to being retrofit with the deck assembly.
Figure 6:
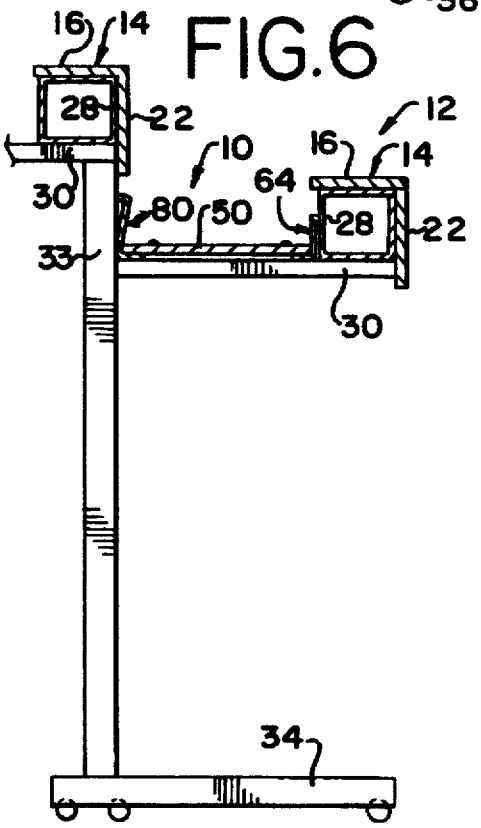
FIG. 6 is a partial cross-sectional view of bleachers after being retrofit with the deck assembly of the present invention.
Figure 7:
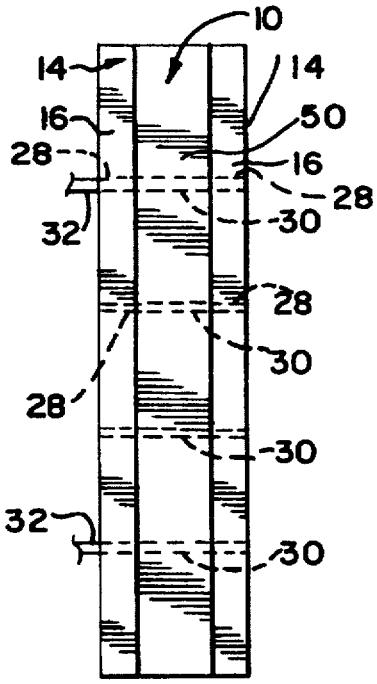
FIG. 7 is a partial plan view of bleachers after being retrofit with the deck assembly of the present invention.
Figure 8:
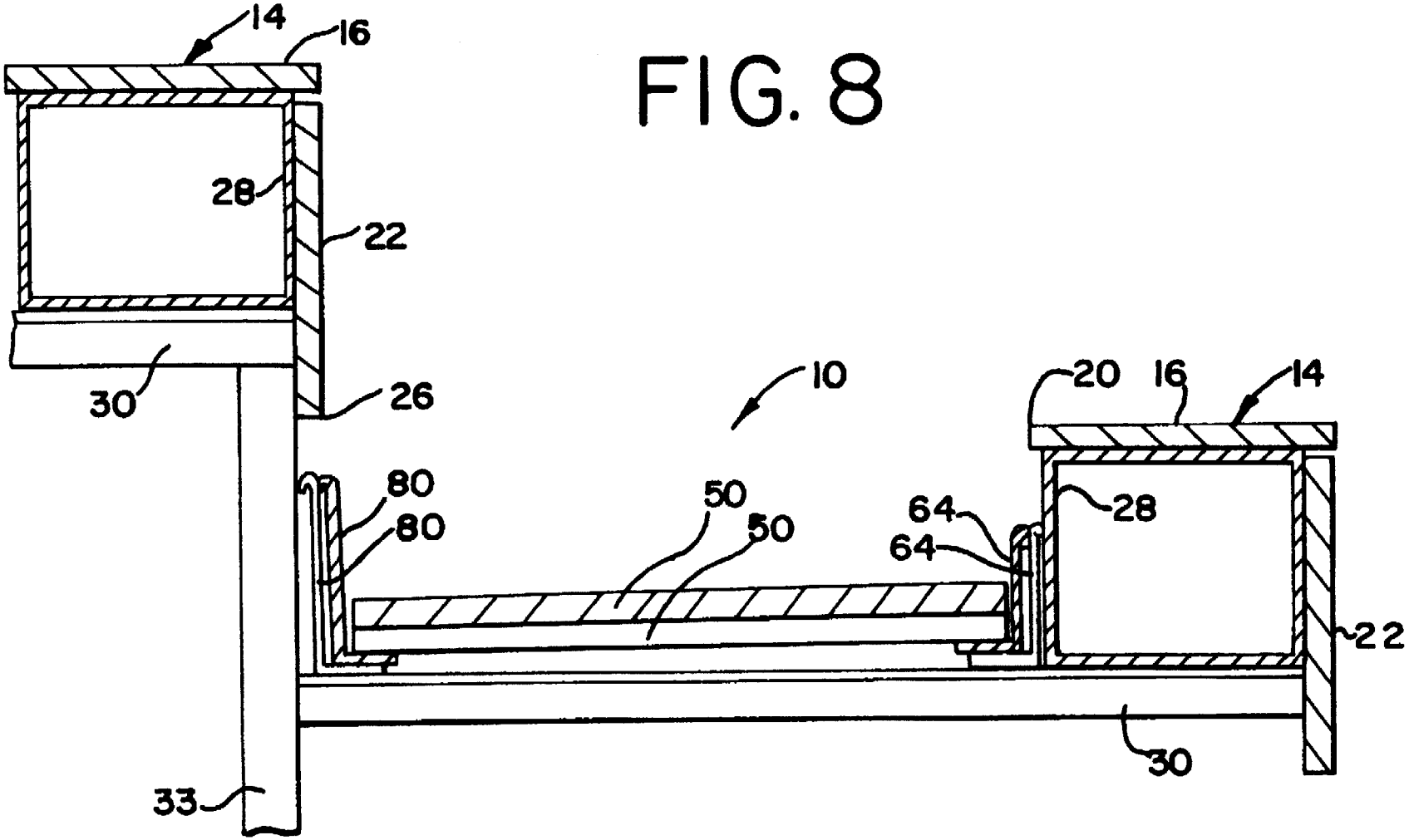
FIG. 8 is a partial cross sectional view of two overlapping retrofit deck assemblies.

The retrofit deck assembly 10 of the present invention is shown installed in bleachers 12 in FIG. 1. The bleachers 12, prior to being retrofit with the deck assembly 10, are shown in FIGS. 4 and 5. The bleachers 12 include a plurality of rows of seats 14 located in a tiered relationship with respect to one another. Each row of seats 14 includes a generally horizontal seat board 16 having a front edge 18 and a spaced apart and generally parallel rear edge 20. Each row of seats 14 also includes a generally vertical skirt board 22 having a top edge 24 and a bottom edge 26. The seat board 16 and skirt board 22 of each row of seats 14 is attached to and supported by a plurality of brackets 28 which are spaced apart from one another along the longitudinal length of the boards 16 and 22. The brackets 28 are generally rectangular and tubular in cross section and are generally two to three inches wide. Each row of seats 14 and the associated brackets 28 are supported by a plurality of spaced-apart floor support members 30. Each floor support member 30 extends from a forwardly located row of seats 14 to an adjacent rearwardly located row of seats 14. The floor support members 30 are directly or indirectly attached to and supported by two or more horse assemblies 32. Each horse assembly 32 includes a vertical post 33 and a base 34 having a plurality of rotatable wheels 36. The horse assemblies 32 are bleacher-inwardly spaced to be telescopically related and provide rolling movement of the seats 14 over a floor surface as the rows of seats 14 of the bleachers 12 are telescopically retracted or extended in a usual way. The pre-existing bleachers 12 also include a foot board 38 located between each adjacent row of seats 14 which is attached to and supported by the floor support members 30. The foot board 38 is typically nine inches wide such that there is a large L-shaped opening 40 located between the foot board 38 and the seat board 16 of the forward row of seats 14 and a large L-shaped opening 42 located between the foot board 38 and the skirt board 22 of the rearward row of seats 14. The L-shaped openings 40 and 42 are large in that they will allow a four inch diameter sphere to pass horizontally and/or vertically therethrough.

Figure 2:
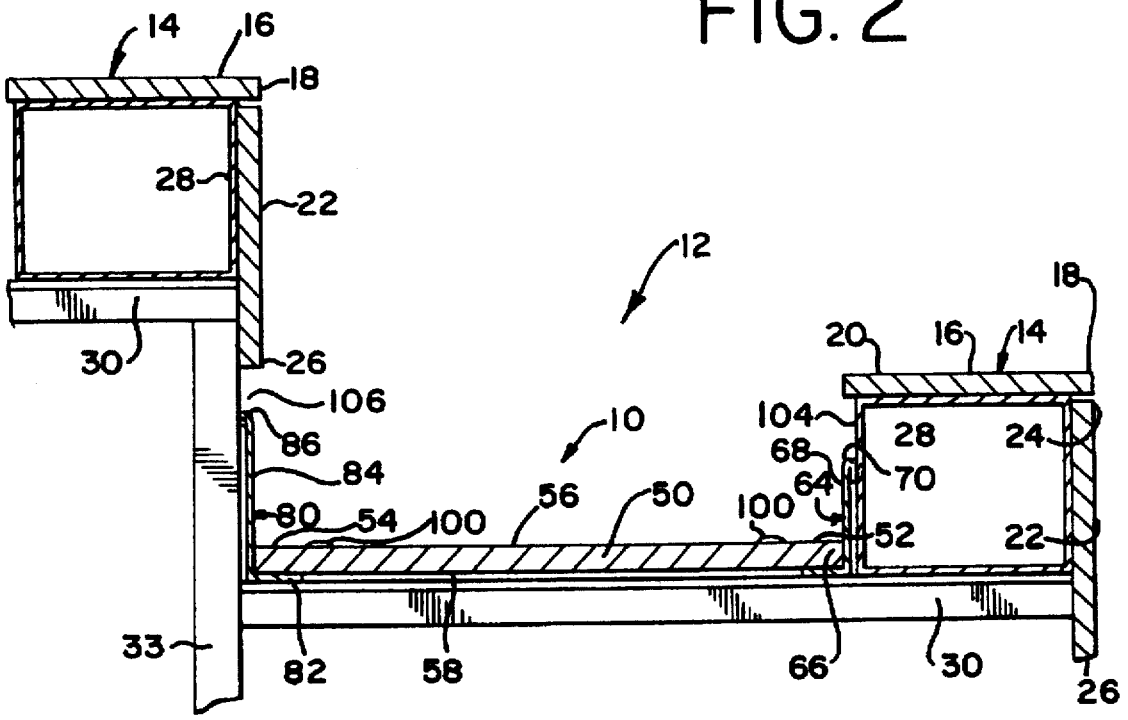
FIG. 2 is a partial cross-sectional view of the bleachers taken along lines 2—2 of FIG. 1.

The retrofit deck assembly 10 is generally U-shaped, as best shown in FIG. 2, and includes an elongate rectangular walkway panel 50 having a first elongate and generally linear edge 52 and a second elongate and generally linear edge 54 which is spaced-apart from, and generally parallel to, the first edge 52. The walkway panel 50 includes a generally planar upper walkway surface 56 and an opposing lower surface 58. The walkway panel 50 is preferably formed from three-quarter inch thick plywood, but other thicknesses and materials may be used as desired. The walkway panel 50 has a width such that the first edge 52 is located substantially vertically below the rear edge 20 of the forward seat 14 and such that the second edge 54 is located substantially vertically below the front edge 18 of the seat board 16 of the rear seat 14 and the bottom edge 26 of the skirt board 22 of the rear seat 14.

The deck assembly 10 also includes an elongate toe riser 64. The toe riser 64 is generally L-shaped and includes a generally planar and horizontal base 66 and a generally planar and vertical upstanding flange 68. The flange 68 extends upwardly from the base 66 to a linear top edge 70 at an approximate angle of ninety degrees to the base 66. The top end 70 of the flange 68 may be rolled over as shown in FIG. 2 or formed with an outwardly extending lip. The toe riser 64 may be made from sixteen gage galvanized steel or in other thicknesses and materials as desired.

The deck assembly 10 also includes an elongate heel riser 80. The heel riser 80 is preferably generally L-shaped and includes a generally planar and horizontal base 82, and a generally vertical and planar upstanding flange 84. The flange 84 extends upwardly from the base 82 at an angle of approximately ninety degrees to a generally linear top edge 86. The top end of the flange 84 may be rolled over as shown in FIG. 2 or formed with an outwardly extending lip. The heel riser 80 is preferably made from fourteen gage galvanized steel, but may be made in other thicknesses and with other materials as desired.

Figure 3:
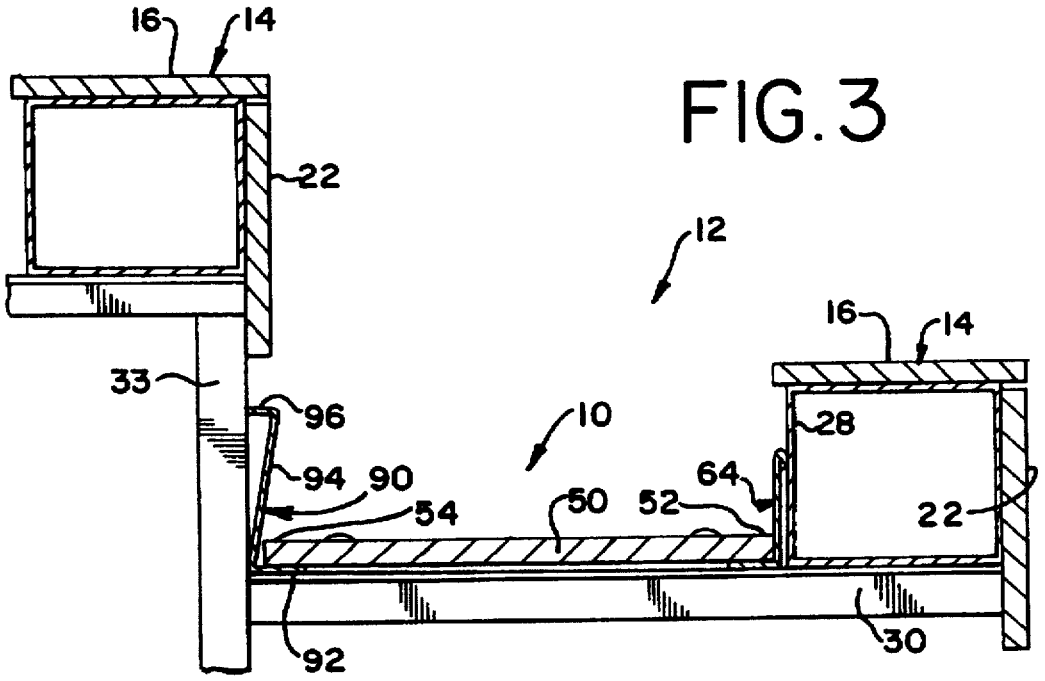
FIG. 3 is an alternate embodiment of the retrofit deck assembly.

Alternatively, as shown in FIG. 3, the deck assembly 10 may include a generally Z-shaped heel riser 90. The heel riser 90 includes a generally planar and horizontal base 92, a generally planar upstanding flange 94 which extends upwardly from the base 92 at an angle to the vertical, and a lip 96 which extends outwardly and generally horizontally from the top edge of the flange 94.

In operation, the pre-existing foot boards 38 of the bleachers 12 are removed from the floor support members 30. The toe riser 64 is then placed on the floor support members 30 generally parallel to the rows of seats 14 such that the base 66 engages the floor support members 30 and such that the flange 68 is located adjacent the brackets 28 of the forward row of seats 14. The heel riser 80 is also placed on the floor support members 30 generally parallel to the rows of seats 14 such that the base 82 engages the floor support members 30. The flange 84 of the heel riser 80 is located adjacent the vertical posts 33 of the horse assemblies 32. Depending upon the longitudinal length of the rows of seats 14, one or more toe risers 64 and one or more heel risers 80 may be placed end to end. Alternatively, the toe risers 64 may be overlapped with one another to adjust their overall length and the heel risers 80 may also be overlapped with one another to adjust their overall length. As an example, when the rows of seats 14 of the bleachers are fifteen feet long, two eight-foot lengths of risers 64 and two eight-foot lengths of heel risers 80 may each be overlapped with one another by one foot to provide a fifteen foot overall length. The heel and toe risers 64 and 80 are preferably made in either eight or ten foot lengths.

Once the toe risers 64 and the heel risers 80 are in place, the walkway panel 50 is lowered between the upstanding flanges 68 and 84 until the lower surface 58 of the walkway panel 50 is seated in engagement with the base 66 of the toe riser 64 and base 82 of the heel riser 80. One or more walkway panels 50 may by located between the toe riser 64 and heel riser 80 in an end to end relation to accommodate the particular length of the rows of seats 14. Depending on the longitudinal length of the rows of seats 14, one or more walkway panels 50 maybe overlapped with one another to adjust their overall length. As an example, when the rows of seats 14 are fifteen feet long, two eight-foot lengths of walkway panels 50 may be overlapped with one another by one foot to provide a fifteen foot overall length. The walkway panels 50 are preferably made in eight or ten foot lengths. The walkway panel 50 of the preferred embodiment wedges the toe riser 64 against the bracket 28 and wedges the heel riser 80 against the posts 33. The walkway panels 50 are secured to the floor support members 30 by a plurality of fasteners 100 such as self-drilling and tapping screws. The toe riser 64 may be secured to the adjacent brackets 28 by fasteners, if desired, and the heel riser 80 may be secured to the adjacent posts 33 by fasteners if desired. The bases 66 and 82 of the toe riser 64 and heel riser 80 may also be secured to the floor support members 30 and/or the walkway panel 50 by fasteners.

As best shown in FIG. 2, the flange 68 of the toe riser 64 substantially encloses the area between the walkway surface 56 of the walkway panel 50 and the rear edge 20 of the seat board 16 of the forward row of seats 14. The flange 84 of the heel riser 80 similarly substantially encloses the area between the walkway surface 56 of the walkway panel 50 and the bottom edge 26 of the skirt board 22 of the rear row of seats 14. As used herein, an area is "substantially enclosed" when the area will not allow a four inch diameter sphere to pass therethrough, although the area may contain an opening. The flange 68 of the toe riser 64 may be provided in various different heights as desired such that the top edge 70 of the flange 68 may be located as closely adjacent to the seat board 16 of the forward row of seats 14 as desired to provide an opening 104 between the top edge 70 and the forward row of seats 14 of the desired size. Similarly, the flange 84 of the heel riser 80 may be provided in various different heights as desired such that the top edge 86 may be located as closely adjacent to the rear row of seats 14 as desired to provide an opening 106 between the top edge 86 and the rearward row of seats 14 of the desired size. Thus, the size of the openings 104 and 106 may be selectively adjusted in size, or eliminated, by utilizing toe risers 64 and heel risers 80 with flanges of various different heights to prevent the passage of objects through the openings.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A retrofit assembly installed in telescoping bleachers previously having toe and heel openings greater than four inches between floor boards and adjacent rows of seats, the bleachers including support members for supporting the floor boards, each row of seats having a front edge and a rear edge and being supported by a bracket having a generally vertical leg located adjacent the rear edge of the row of seats, comprising:

a toe riser located adjacent the vertical leg of a bracket supporting a first row of seats and generally vertically below the rear edge of the first row of seats;

a heel riser parallel to and spaced a distance from the toe riser;

a walking panel having a first edge and a second edge, the walking panel extending for substantially the entire said spaced distance between said toe riser and said heel riser, said first edge of said walking panel located generally vertically below the rear edge of the first row of seats, said walking panel supported by the support members; and said retrofit assembly adapted to provide heel and toe openings equal to or less than four inches between said toe and heel risers and the adjacent rows of seats of the telescoping bleachers.

2. The retrofit assembly of claim 1 wherein said toe riser includes a flange and a base attached to said flange, said base engaging said walking panel.

3. The retrofit assembly of claim 2 wherein said toe riser is generally L-shaped.

4. The retrofit assembly of claim 1 wherein said heel riser includes a flange and a base attached to said flange, said base engaging said walking panel.

5. The retrofit assembly of claim 4 wherein said heel riser is generally L-shaped.

6. The retrofit assembly of claim 1 wherein said walking panel includes an upper walkway surface and an opposing lower surface, said toe riser including a flange and a base member extending outwardly at an angle from said flange of said toe riser, said base member of said toe riser engaging said walking panel at said first edge, and said heel riser including a flange and a base member extending outwardly at an angle from said flange of said heel riser, said base member of said heel riser engaging said walking panel at said second edge.

7. The retrofit assembly of claim 6 wherein said base member of said toe riser and said base member of said heel riser each engage the lower surface of the walking panel and are each adapted to engage the support members.

8. The retrofit assembly of claim 6 wherein said heel riser includes a lip member extending outwardly from a top edge of said flange of said heel riser.

9. The retrofit assembly of claim 6 wherein said flange of said toe riser and said flange of said heel riser are each substantially perpendicular to said upper walkway surface of said walking panel.

* * * * *